US005489084A

United States Patent [19]

Gilbert et al.

[11] Patent Number: 5,489,084

[45] Date of Patent: Feb. 6, 1996

[54] METHOD OF CONFIGURING A CARPET ROLL

[76] Inventors: James M. Gilbert; Michael L. Marshall, both of 2800 Quebec St., NW., Suite 1021, Washington, D.C. 20008

[21] Appl. No.: 258,987

[22] Filed: Jun. 13, 1994

[51] Int. Cl.[6] ..... B25B 25/00

[52] U.S. Cl. ..... 254/202; 264/339

[58] Field of Search ..... 254/202, 213, 254/217, 243; 72/302, 369, 370; 414/786, 911; 264/339

[56] References Cited

U.S. PATENT DOCUMENTS

| | | | |
|---|---|---|---|
| 1,353,083 | 9/1920 | Stephens | 254/213 X |
| 2,634,093 | 4/1953 | Hays | 254/213 |
| 2,697,469 | 12/1954 | Becroft | 72/380 |
| 2,755,761 | 7/1956 | Carr | 72/380 X |
| 3,875,783 | 4/1975 | Proof | 72/369 X |
| 3,955,599 | 5/1976 | Walker | 72/369 X |
| 4,704,886 | 11/1987 | Evert et al. | 72/369 X |
| 4,740,131 | 4/1988 | Mayle | 414/911 X |
| 5,018,708 | 5/1991 | Shaffer | 254/213 X |

*Primary Examiner*—Joseph J. Hail, III

*Attorney, Agent, or Firm*—Watson, Cole, Grindle & Watson

[57] ABSTRACT

A method of bending a roll of carpet to reduce its length so that it may be transported by a single individual, which includes inserting a tube in each end of the roll, attaching a band to each tube, and then drawing the bands together to cause the carpet to fold at a location between its ends.

6 Claims, 1 Drawing Sheet

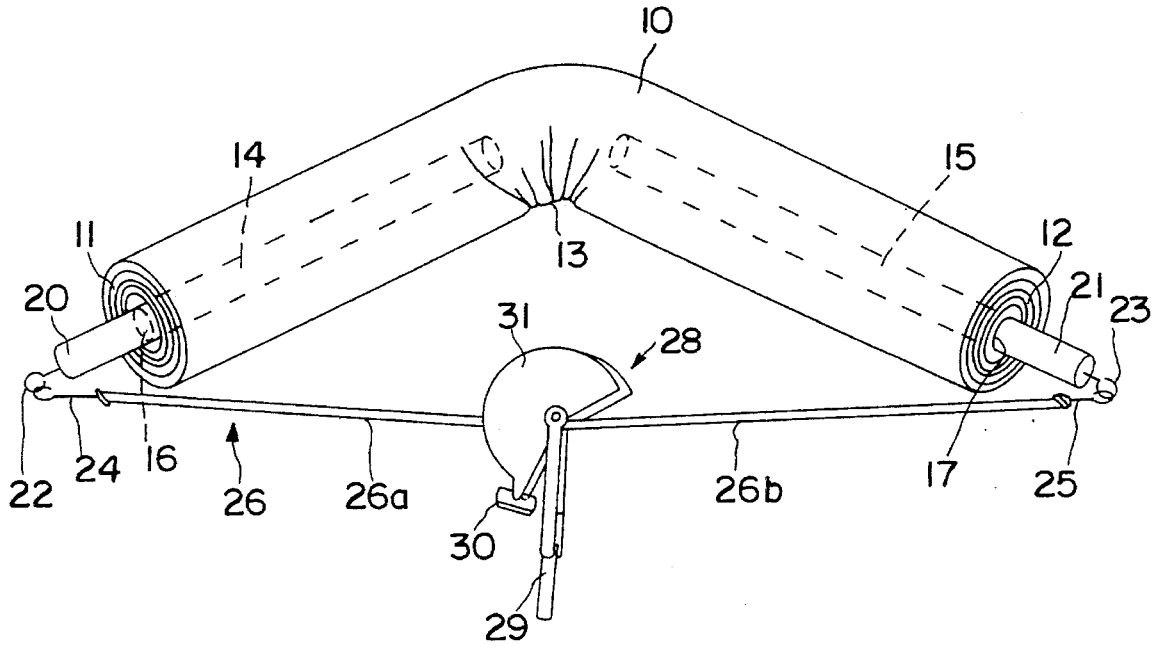
10
14
15
11
12
13
20
21
23
31
28
22
24
16
26
26a
26b
17
25
30
29

METHOD OF CONFIGURING A CARPET ROLL

BACKGROUND OF THE INVENTION

The present invention relates in general to a method of configuring a roll of carpet or similar material so that it will be more easily transportable. More specifically, it is directed to a method of bending a roll of carpet upon itself to reduce its overall length by one-half.

Rolls of carpet and like materials come in extended lengths and are then cut to size, often at the site of installation where they are to be laid. Carpet installers, therefore, must transport heavy rolls, usually twelve feet in length, to a job site, for example, an office where the carpet is to be laid. When carpet is to be installed in an office at an upper floor of a building, the problem of transporting the carpet to the office is apparent, and the installer is left with the choice of carrying a 100-lb. roll of carpet up, say 30 floors of stairwell, or trying to cram a 12-foot long roll into a freight elevator that has a maximum usable dimension of eight feet.

It will be apparent that the highly preferred alternative of choice is to bend or "break" the carpet roll at a location proximate to the center of its longitudinal axis. If this can be done, the effective length of the roll can be reduced by almost one-half, and the length of the roll will have been reduced to six feet, which is well within the dimensions of almost any freight or even passenger elevator. However, the amount of strength required to even start to cause a carpet roll to bend along its longitudinal axis is considerable, often beyond the capacity of a pair of installers. When a single installer is transporting a roll, or even a fraction of a roll of carpet to a job, it is simply impossible for him to cause the carpet to break and then, while holding one or both ends of the carpet roll in juxtaposed position, to secure those ends in a location so that they are adjacent to each other.

It is, therefore, a primary object of the present invention to provide a method of configuring a roll of carpet so that it may be transported by a single individual to the site at which it is to be laid using an elevator or other confined area.

It is a more specific object of our invention to provide a method of causing a roll of carpet to bend back upon itself to a position in which the two ends of the roll are brought into a position in which they are closely spaced from each other, thereby greatly reducing the linear length dimension of the roll so that it may more easily be accommodated in an elevator or other confined area.

SUMMARY OF THE INVENTION

In summary, our invention comprises providing a roll of carpet in a position so that access may be had to the two open ends of the roll, which are spaced from each other by the maximum longitudinal dimension of the roll. A tube is inserted into each of the open ends to a location at which withdrawal of the tube in other than an axial direction is significantly hampered. Each tube is accessible at its outwardly extending end, which terminates with fastening means. A band, cable or the like having sufficient strength to resist rupture under carpet breaking stress is attached to each of the fastening means. Then the effective length of the band is reduced, pulling the fastening means on the tubes and, therefore, the carpet ends, toward each other to a position in which the longest dimension of the roll has been significantly reduced and the roll has been rendered more easily transportable.

In somewhat more specific aspects of the present invention, the roll is bent upon itself until it assumes a substantially U- or V-shape, and once having been brought to that position, a belt is wrapped around the ends to maintain the roll in that shape. In order to start the bending of the roll, pressure may be applied, usually by one's foot, at the intended break point to encourage bending at that location. After the roll has been transported to its desired location in its U-shaped configuration, it is then allowed to assume its original, fully extended position by removing the holding belt, releasing the retracted band, and finally disengaging the insert tubes from the opposed ends of the roll.

These and other objects, features and advantages of our invention will become more readily apparent from the following, detailed description of a preferred embodiment of the invention, which is described with reference to a diagrammatic illustration of a carpet in the process of being configured in accordance with our invention, as shown in the accompanying drawing consisting of a single Figure.

BRIEF DESCRIPTION OF THE DRAWING

The drawing is a diagrammatic illustration of a carpet in the process of being configured according to the present invention. The drawing shows the carpet with a break in the roll at the center thereof and its ends being drawn toward each other by means of a ratchet, as will be further disclosed in the following description.

DESCRIPTION OF PREFERRED EMBODIMENT

As there illustrated, a roll of carpet 10 is formed with two open, opposed ends 11 and 12 which, when the carpet is in a substantially unstressed, horizontal position, are spaced from each other by the full length of the roll, usually twelve feet. As shown in the accompanying illustration, however, the carpet roll 10 has started to bend substantially at its mid or break point 13.

The carpet is brought to the position illustrated in the drawing Figure by insertion of tubes 14 and 15 in the orifices formed by the open ends of the carpet roll 10, which orifices are identified by reference numerals 16 and 17, respectively. As so inserted, tubes 14 and 15 are relatively long and have a major portion of their length lying within the orifices 16 and 17, with minor portions 20 and 21 of the tubes extending outwardly from the orifices 16 and 17.

In the embodiment illustrated, the minor portions 20 and 21 of tubes 14 and 15, which may be made of wood or metal, terminate in eye bolts 22 and 23, which act as fastening means cooperating with hook-like terminal extensions 24 and 25 of a band 26 with flights **26*a* and 26*b* that pass through and are lengthened or shortened by means of a ratchet 28 actuated by lever 29**.

The ratchet, indicated generally by reference numeral 28, is what is known as a bungee ratchet. The ratchet on which that used in the present invention is based was purchased from Trak Auto in Falls Church, Va., and is identified by Model No. 115. It was modified by incorporating a spool guard 31 to protect the internal spool (not shown), so that when larger amounts of band 26 are retracted about the spool, they will wind evenly and be retained on the spool. As will be apparent, in any bungee ratchet of this type the ratchet is actuated by a lever 29 to ratchet both flights **26*a* and 26*b* of the band 26 up and about the internal spool protected by the spool guard 31. The other modification of the bungee ratchet purchased commercially and readily available was to locate a handle 30 at one end of spool guard 31 for the convenience of the carpet installer who can then grasp bungee ratchet 28 by handle 30 with one hand while pumping lever 29 to retract both band flights 26a and 26b about the spool of the ratchet. Conventionally, the ratchet has a release so that band 26 may be unrolled from the spool. The conventional spool has a slot through which the band flights are inserted whereby, when the spool is actuated by means of the lever 29**, the bands will be rolled together about the spool at the same time.

As the effective length of the band 26 is shortened to create a position of the roll of carpet similar to that illustrated in the drawing, a break or bend in the roll occurs at about the position of numeral 13. This bend is advantageously assisted by pressure at location 13 by the foot of the installer as the ratchet is actuated, so that the break does not occur at some portion along the roll remote from its center, which is the most advantageous location for the break to occur.

In operation, the method of my invention is practiced by laying the carpet roll 10 flat on the floor or at least in a horizontal position. Tubes 14 and 15 are then inserted into the respective orifices 16 and 17 to positions in which the minor, outwardly extending portions 20 and 21 of the tubes protrude from the orifices by a predetermined amount, say two inches, and the major portions of the tubes lie snugly within the orifices 16 and 17. Then hooks 24 and 25 attached to ends of band 26 are positioned to grasp eyebolts 22 and 23 in the ends of the tubes. Now, with the foot of the installer at location 13 on the roll, ratchet 28 is actuated by placing one hand on handle 30 and the other to move lever 29 to gradually shorten the effective length of band 26 and draw eyebolts 22 and 23 toward each other until the carpet has been forced into a generally U-shaped configuration. That shape is maintained and secured, preferably by wrapping an adjustable belt around the ends of the roll 10 to ease the pressure on the ratchet.

The carpet roll in U-shaped configuration is then moved into an elevator or other limited access locale and transported to the place where the carpet is to be laid, after which the belt is removed, the ratchet actuator placed in reverse mode and the band allowed to lengthen until the roll has once again assumed a substantially linear, extended position. Band hooks 24 and 25 are then released from the tube eyebolts 22 and 23 and the tubes 14 and 15 withdrawn from the ends 11 and 12 of roll 10 through orifices 14 and 15. The carpet is then laid from the roll.

It will be apparent to those of skill in this art that my invention has been described hereinbefore with reference only to what I presently consider the best mode of my invention and the most convenient and readily available and economic means for carrying out that invention. Other materials may be used in carrying out the method. For example, use of the term, band, herein is meant to include not only a flat strip of metal but other materials and forms, such as a wire cable, and while the invention has been described with reference to a ratchet type of device for shortening or lengthening the effective length of the band or rope, it will be obvious that many other devices, e.g., a turnbuckle, might be used under appropriate conditions.

As to all such variations and modifications of the present invention and materials used to place that invention into operation, we desire that they be interpreted to fall within the purview of my invention, which is to be limited only by the scope, including equivalents thereof, of the following, appended claims.

What is claimed is:

1. A method of configuring a roll of carpet so that it may be transported by a single individual in spaces of limited maneuverability, comprising (a) providing a roll of carpet in position so that access may be had to the two open ends thereof;

(b) inserting in each of said ends a tube dimensioned to fit within its end axially of the roll to a location at which withdrawal other than in an axial direction is significantly hampered by pressure of said tube against the interior of said roll but said tube is accessible through its end, each of said tubes being formed with fastening means at one end thereof, (c) positioning each of said tubes so that said fastening means extends in a direction outwardly of said roll end;

(d) attaching to each of said fastening means a band the effective length of which is subject to variation, said band having sufficient strength to resist rupture under carpet breaking stress; and (e) reducing the effective length of said band in tube attached position to pull said fastening means and said carpet roll ends toward each other to a position in which the effective length of the roll is reduced and the roll is thereby rendered more easily transportable.

2. A method as claimed in claim 1, in which the effective length of said band is reduced until said roll is bent into a substantially U-shaped configuration.

3. A method of configuring a roll of carpet so that it may be transported by a single individual in spaces of limited maneuverability, comprising (a) providing a roll of carpet in position so that access may be had to the two open ends thereof;

(b) inserting in each of said ends a tube dimensioned to fit within its end axially of the roll to a location at which withdrawal other than in an axial direction is significantly hampered by pressure of said tube against the interior of said roll but said tube is accessible through its end, each of said tubes being formed with fastening means at one end thereof, (c) positioning each of said tubes so that said fastening means extends in a direction outwardly of said roll end;

(d) attaching to each of said fastening means a band the effective length of which is subject to variation, said band having sufficient strength to resist rupture under carpet breaking stress;

(e) applying pressure at about the midpoint of the length of the roll to create an initial break in the roll so that as force is applied to the ends of the roll to bring those ends toward each other, the roll will bend at said break; and (f) reducing the effective length of said band in tube attached position to pull said fastening means and said carpet roll ends toward each other to a position in which the effective length of the roll is reduced and the roll is thereby rendered more easily transportable.

4. A method as claimed in claim 3, in which said pressure is applied by foot.

5. A method as claimed in claim 4, in which said bands are drawn toward each other by means of a mechanical ratchet that simultaneously reduces the length of said bands between said ratchet and said tubes inserted in said roll ends.

6. A method of configuring a roll of carpet by an individual without assistance so that it may be transported by that individual in spaces of limited maneuverability, comprising (a) providing a roll of carpet in substantially horizontal position so that access may be had to the two open ends of the roll;

(b) inserting in each of said ends of said roll a cylindrical tube having a diameter sufficiently small that it can fit axially within said open end and extend outwardly from said open end, a major portion of the length of said tube being located within said carpet roll end and a minor portion thereof extending outwardly beyond the end of said roll so that withdrawal of said tube other than in an axial direction is significantly hampered by pressure of said tube against the interior of said roll, each of said tubes being formed with fastening means at an end thereof, said fastening means being formed to releasably retain cooperating fastening means;

(c) positioning each of said tubes so that said tube fastening means extends in a direction outwardly of said roll end;

(d) attaching to each of said fastening means a band having cooperating fastening means, said bands having sufficient strength to resist rupture under carpet breaking stress;

(e) drawing said bands together so that in their band attached position said ends of said carpet roll are drawn toward each other as the effective length of the roll is reduced;

(f) continuing to draw said bands together until said roll has been brought to a substantially U-shaped configuration;

(g) maintaining said roll in said U-shaped configuration independently of said bands; and (h) releasing said bands and removing said tubes from the ends of said roll.

* * * * *